US008584844B2

(12) United States Patent
Tearle

(10) Patent No.: US 8,584,844 B2
(45) Date of Patent: Nov. 19, 2013

(54) PACKAGE FOR SMOKING ARTICLES

(75) Inventor: Alan Douglas Tearle, Hampshire (GB)

(73) Assignee: British American Tobacco (Investments) Limited, London (GB)

( * ) Notice: Subject to any disclaimer, the term of this patent is extended or adjusted under 35 U.S.C. 154(b) by 88 days.

(21) Appl. No.: 12/597,879

(22) PCT Filed: Apr. 29, 2008

(86) PCT No.: PCT/ZA2008/000034

§ 371 (c)(1), (2), (4) Date: Mar. 26, 2010

(87) PCT Pub. No.: WO2008/134779

PCT Pub. Date: Nov. 6, 2008

(65) Prior Publication Data

US 2010/0176010 A1 Jul. 15, 2010

(30) Foreign Application Priority Data

Apr. 27, 2007 (GB) ..... 0708245.6

(51) Int. Cl.
*B65D 85/10* (2006.01)

(52) U.S. Cl.
USPC ..... 206/267; 206/256; 206/273

(58) Field of Classification Search
USPC ..... 206/256, 242, 254, 249, 257, 262, 261, 206/264, 271, 273, 267, 270, 265; 229/120.01; 220/23.88
See application file for complete search history.

(56) References Cited

U.S. PATENT DOCUMENTS

| | | | | | |
|---|---|---|---|---|---|
| 727,600 | A * | 5/1903 | Doscher | 229/120.03 |
| 1,112,752 | A * | 10/1914 | Avellanal | 206/256 |
| 1,158,826 | A * | 11/1915 | Mendelson | 206/256 |
| 1,877,468 | A * | 9/1932 | Enfant | 206/256 |
| 2,329,866 | A | 9/1943 | Sickels | |
| 3,052,398 | A * | 9/1962 | Lewin | 229/125.37 |
| 3,439,797 | A * | 4/1969 | Cooper et al. | 206/249 |
| 3,749,234 | A * | 7/1973 | Gero | 206/266 |
| 3,881,599 | A * | 5/1975 | Flaherty | 206/273 |
| 4,534,463 | A * | 8/1985 | Bouchard | 206/267 |
| 5,080,227 | A * | 1/1992 | Focke | 206/273 |
| 5,467,872 | A * | 11/1995 | Minarelli et al. | 206/256 |
| 6,296,113 | B1 * | 10/2001 | Bartels et al. | 206/261 |
| 6,557,700 | B1 * | 5/2003 | Wharton | 206/308.1 |
| 7,377,385 | B2 * | 5/2008 | Giannini et al. | 206/267 |
| 7,866,466 | B2 * | 1/2011 | Rose et al. | 206/267 |
| 8,042,686 | B2 * | 10/2011 | Wynalda et al. | 206/308.1 |
| 8,225,931 | B2 * | 7/2012 | Wharton | 206/468 |
| 2008/0149507 | A1 * | 6/2008 | Rose et al. | 206/267 |
| 2008/0289977 | A1 * | 11/2008 | Ghini et al. | 206/256 |
| 2011/0062037 | A1 * | 3/2011 | Bertuzzi et al. | 206/267 |

FOREIGN PATENT DOCUMENTS

| | | |
|---|---|---|
| GB | 505550 A | 5/1939 |
| GB | 2150119 A | 6/1985 |

(Continued)

OTHER PUBLICATIONS

PCT International Search Report and Written Opinion, Aug. 11, 2008.

*Primary Examiner* — Steven A. Reynolds
(74) *Attorney, Agent, or Firm* — N W Poulsen

(57) ABSTRACT

A package in the form of a slide-shell pack has an outer shell and a plurality of inner compartments, each adapted to receive smoking articles. The inner compartments are slideable relative to the outer shell to provide access to the smoking articles.

29 Claims, 11 Drawing Sheets

(56) References Cited

FOREIGN PATENT DOCUMENTS

| | | | |
|---|---|---|---|
| GB | 2251600 A | 7/1992 | |
| WO | WO9824696 | 6/1998 | |
| WO | WO2005/090172 | 9/2005 | |
| WO | WO2007007094 A | 1/2007 | |

* cited by examiner

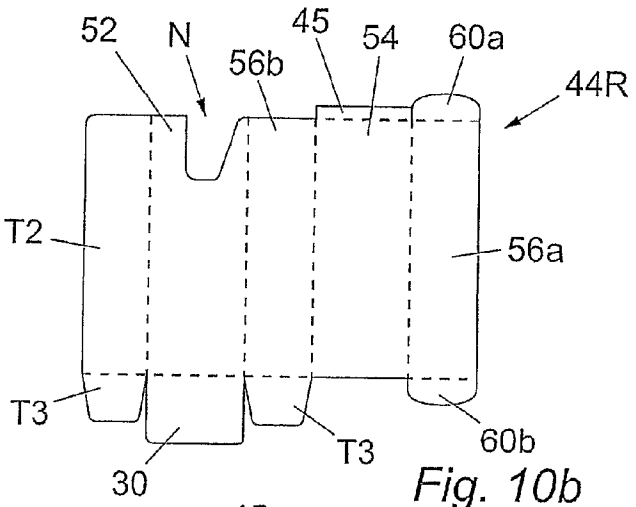
Fig. 10b
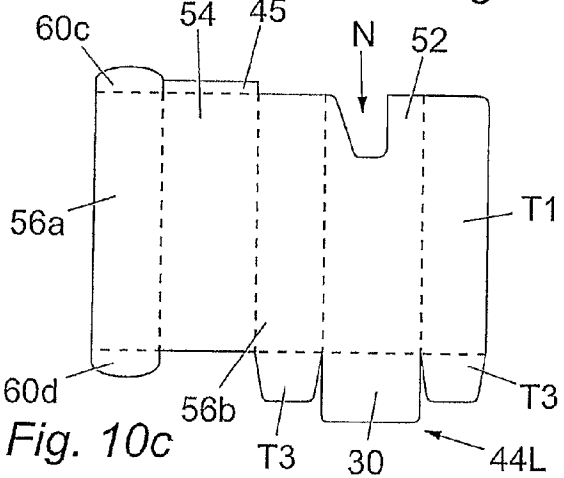
Fig. 10c
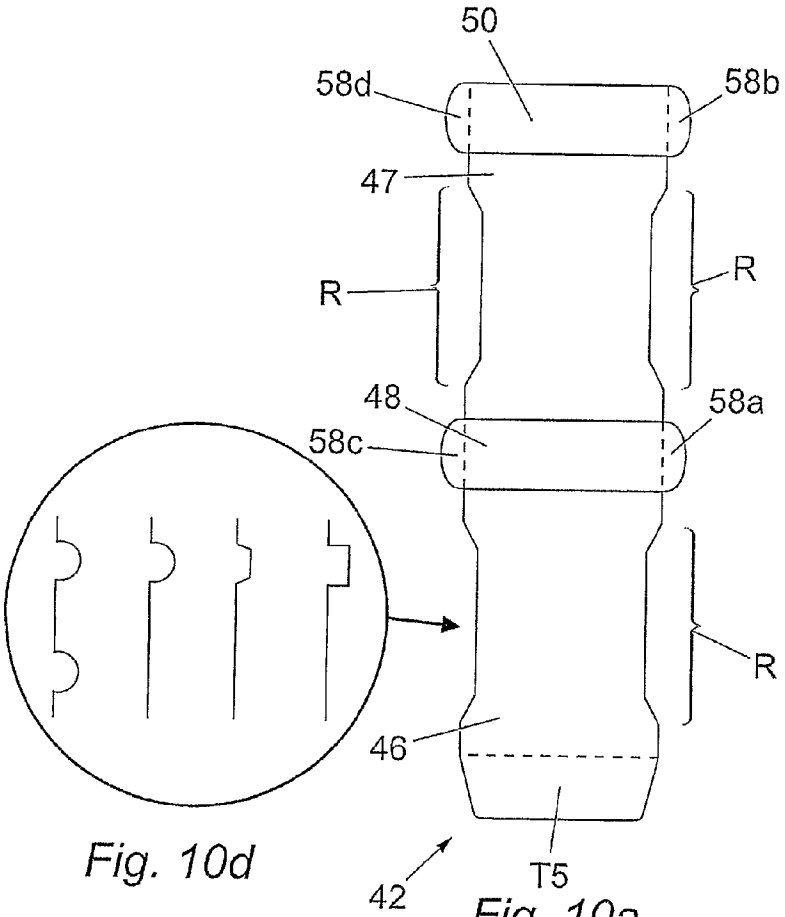
Fig. 10a
Fig. 10d

PACKAGE FOR SMOKING ARTICLES

CLAIM FOR PRIORITY

This application is a National Stage Entry entitled to and hereby claims priority under 35 U.S.C. §§365 and 371 corresponding to PCT Application No. PCT/ZA2008/000034, titled, "Package for smoking articles," filed Apr. 29, 2008, which in turn claims priority to British Application Serial No. 0708245.6, filed Apr. 27, 2007, all of which are hereby incorporated by reference.

FIELD OF THE INVENTION

The invention relates to packaging, more specifically, the invention relates to packages for containing smoking articles and methods for their manufacture, assembly and use.

BACKGROUND OF THE INVENTION

The present invention relates to a package for smoking articles, such as cigarettes, cigars, cigarillos, loose tobacco and smokeless tobacco products such as snuff or the like. For convenience and brevity these will be referred to herein as cigarettes. The invention relates particularly to packages for smoking articles having an inner slide and an outer shell (also known as slide-shell packs). This invention also relates to an assembly of blanks for making a package for smoking articles, an apparatus specially adapted to assemble a package and a method of assembling a package.

Slide-shell packs for smoking articles, such as cigarettes, differ from conventional hinged lid packs in that the smoking articles are provided in an inner shell which the user slides relative to an outer shell to access the smoking articles. A slide-shell pack is known from WO 2004/024595, in which a first container is slidably located within a second container.

A disadvantage of known cigarette packages is that, once opened, all of the smoking articles are exposed to environmental conditions. This allows for the ingress and egress of moisture to and from the contents of the package which may ultimately affect the quality of the contents.

Furthermore, the single inner compartment allows for only one particular product-type. If two different types of smoking article for example having different flavours and/or blends were to be supplied in a known cigarette package, the consumer could not readily identify and select one particular type.

Further, in order that the consumer receives information relating to the product and brand they choose, it is also desirable to maximise the surface area available to provide such information. Previous solutions to this problem have included the provision of coupons in the form of inserts in, or onserts on, the package. One of the disadvantages of this solution is in the provision of additional components and materials adding to the complexity of the packaging process.

SUMMARY OF THE INVENTION

It is an object of the invention to provide an improved package for smoking articles.

According to one embodiment of the invention, a package for smoking articles is provided which comprises an outer shell and a plurality of inner shells, each adapted to receive smoking articles, wherein the inner shells are slideable relative to the outer shell to provide access to smoking articles contained therein.

According to this embodiment, the outer shell can comprise a lateral surface comprising two major lateral walls and two minor lateral walls, a first open end providing a first access opening, and a second open end providing a second access opening. At least one of the lateral walls could have at least one recess adjacent to at least one access opening, to assist gripping of an inner shell. The at least one recess could be provided in a major lateral wall. Optionally, both of the major lateral walls could have a respective recess adjacent to each access opening. The recess could be elongate and extend along a substantial length of the lateral surface adjacent to the access opening, or it could comprise one or more discrete cut-outs.

According to this embodiment, each inner shell can comprise a lateral surface comprising two major lateral walls and two minor lateral walls, a bottom wall, and a top comprising an access opening. The top can comprise an access opening in a region thereof. A removeable or resealable cover can be provided on the access opening. The lateral surface of the inner shell has at least one cut-out portion in an edge thereof, to facilitate removal of the smoking articles from the access opening of the inner shell. Each major lateral wall of the inner shell could have a respective cut-out portion. The access opening can define a direction of removal of the smoking articles. Each inner shell can be independently slideable.

In this embodiment, the inner shells can be slideable in a direction perpendicular to the direction of removal of the smoking articles. A respective locking means can be provided for at least one inner shell to limit the movement of the inner shell relative to the outer shell and defining a fully open position, beyond which further movement of the inner shell is restricted or prevented. The locking means can comprise at least one pair of co-operating tongues, and in such a case a first tongue can be provided on the outer shell and a second tongue on the inner shell, the tongues being adapted to interlock when the inner shell is in the fully open position. Two pairs of co-operating tongues could be provided for the inner shell. The locking means could be provided on adjacent lateral surfaces or adjacent top and bottom end surfaces of the outer and inner shells.

In a package according to the invention, edges of the package can be substantially square, non square, bevelled, rounded, or a combination thereof.

According to a further embodiment of the invention, an assembly of blanks for a smoking article package are provided and comprise an outer shell blank comprising two major panels and two minor panels and at least one inner compartment blank comprising two major panels and two minor panel, wherein a plurality of inner shells are formable from the at least one inner compartment blank. One inner compartment blank could be adapted to form two inner shells, or two or more inner compartment blanks could be provided, each inner compartment blank being adapted to form a respective inner shell.

In an assembly of blanks according to the invention a major panel of the at least one inner compartment blank can be provided with a cut-out portion in an edge thereof, or both major panels could have respective cut-out portions in an edge thereof. Alternatively or in addition, at least one of the major panels of the outer shell, or both, could have a recess provided in a side thereof. In such a configuration, a respective tongue could be provided as an extension portion of at least one side of each major panel of the outer shell and co-operating tongues could be comprised in at least one inner shell.

According to a further embodiment of the invention, an apparatus for assembling a package is provided, the apparatus being adapted to receive a stack of inner shell blanks and a stack of outer shell blanks and to assemble the package so as to provide at least one inner shell within an outer shell such that the assembled package provides a plurality of inner compartments within the outer shell, the plurality of inner compartments being slideable relative to the outer shell.

According to a further embodiment of the invention, a method of making a package is described which comprises the steps of providing an outer shell blank and at least one inner shell blank, and assembling the package so as to provide at least one inner shell within an outer shell such that the assembled package provides a plurality of inner compartments within the outer shell, the plurality of inner compartments being slideable relative to the outer shell.

The outer shell and the inner shell could be provided with respective locking means such as ones comprising co-operating tongues. In such a case the step of inserting the inner shell into the outer shell pushes the co-operating tongues past each other, such that on attempted removal of the inner shell from the outer shell, the tongues interlock to restrict or prevent detachment of the inner shell from the outer shell.

BRIEF DESCRIPTION OF DRAWING FIGURES

In order that the invention be easily understood and readily carried into effect, reference will now be made, by way of example only, to the following drawings, in which:

FIGS. 10A, 10B, 10C and 10D show an assembly of blanks corresponding to the fourth embodiment of FIG. 9;

DETAILED DESCRIPTION

Figure 1:
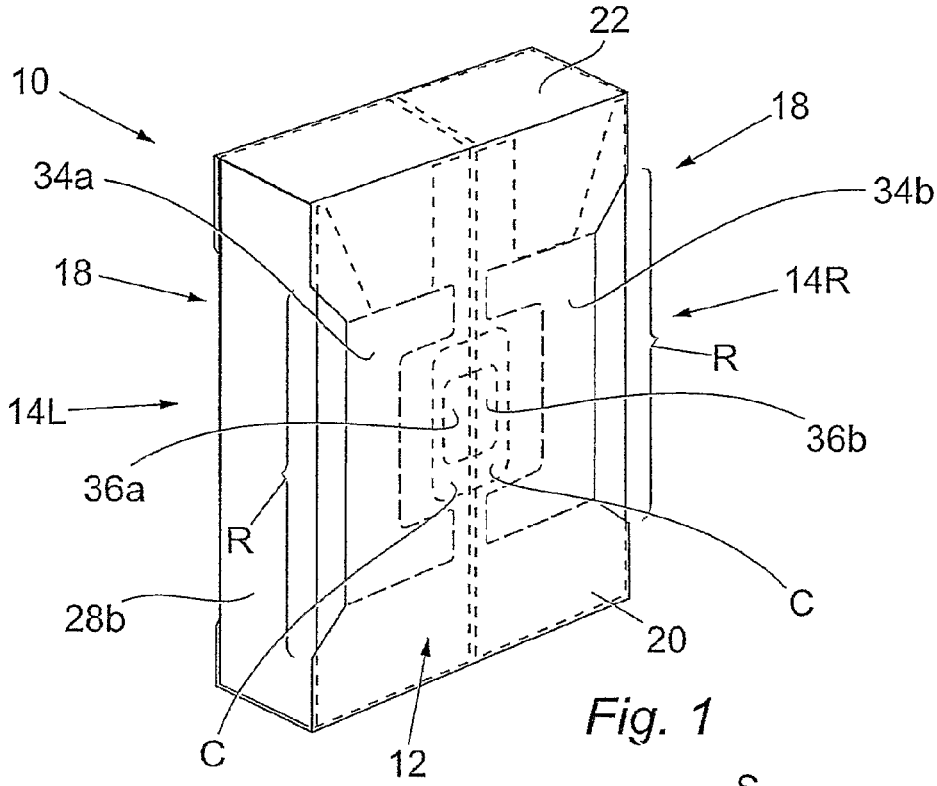
FIG. 1 shows a perspective view of a package according to a first embodiment of the invention is a closed position.

FIGS. 1 to 6 show a package for smoking articles 10, comprising a parallelepiped container with substantially square edges. The package 10 comprises an outer shell 12, a left inner shell 14L and a right inner shell 14F "left" and "right" being defined by the orientation when viewed from the front view of FIG. 3 and being referred to herein merely to assist in the understanding of the present invention and not to imply any specific orientation to the package.

Each inner shell 14 provides a respective inner compartment, in which a charge of smoking articles S is received.

The outer shell 12 has a lateral surface comprising a front major lateral wall 20, a rear major lateral wall 21; a top end wall 22; a bottom end wall 24; and two open ends providing two access openings 18.

Each inner shell 14 comprises a lateral surface comprising a front major lateral wall 26, a rear major lateral wall 27 and two minor lateral walls 28*a*, 28*b*; a bottom wall 30; and a top comprising an access opening 32. The minor lateral walls 28*b* are outermost and are visible from the outside of the package 10. The minor lateral walls 28*a* are innermost, and are not visible in the assembled package 10.

Figure 2:
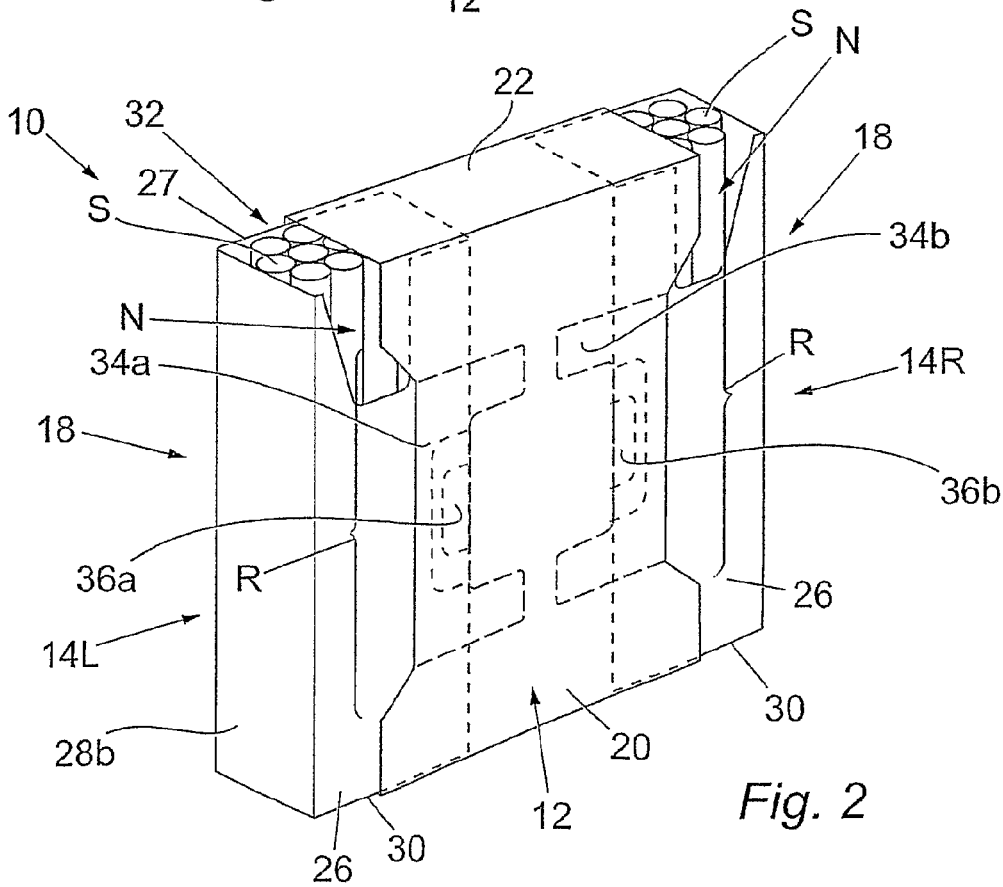
FIG. 2 shows a perspective view of the package of the first embodiment in a fully opened position.
Figure 3:
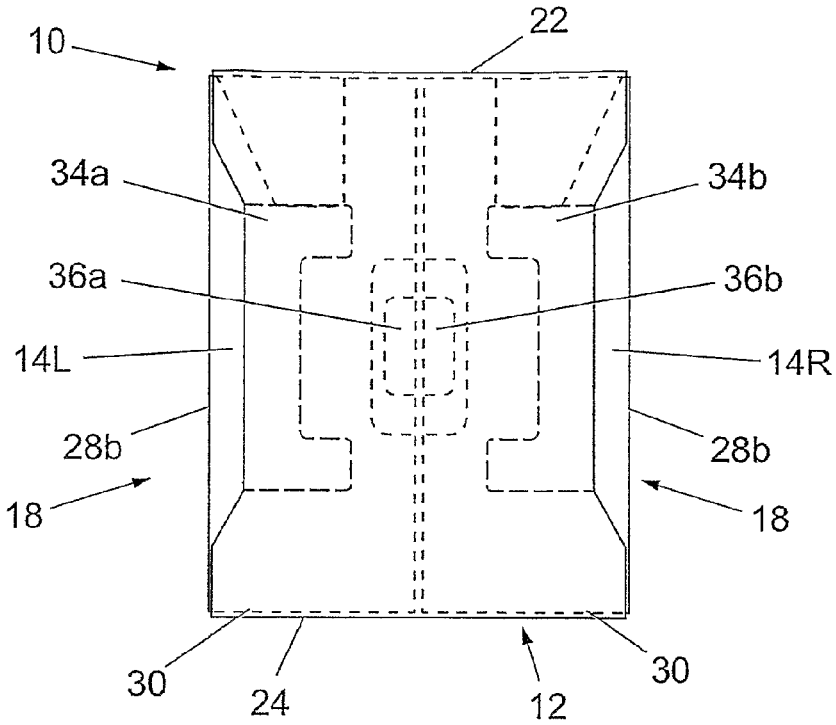
FIG. 3 shows a front view of the package of FIG. 1.
Figure 6:
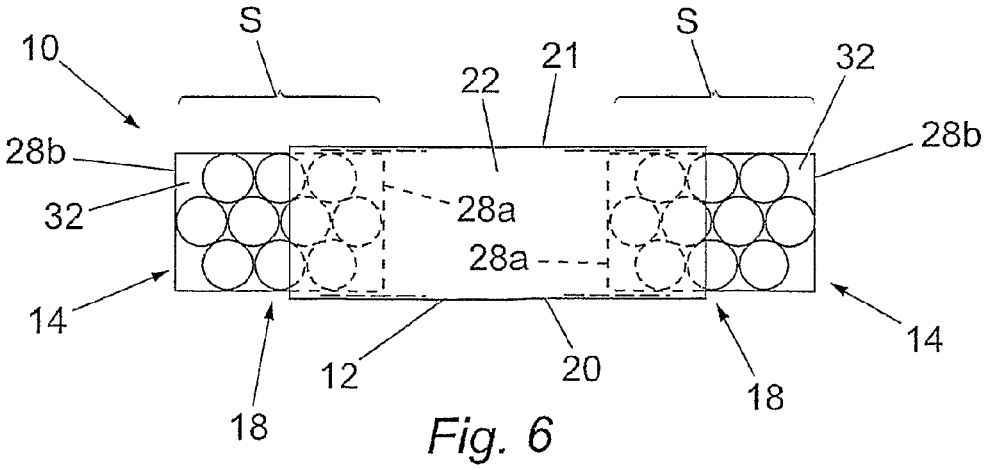
FIG. 6 shows a plan view of the package of FIG. 2.

Each inner shell 14 contains a respective charge of smoking articles, in this example cigarettes S (see FIGS. 2 and 6).

The access opening 32 defines a direction of removal of the cigarettes, i.e. in the embodiment depicted in FIGS. 1-6 the cigarettes are removed upwardly, in a direction perpendicular to the plane of the top wall 22 of the outer shell 12, through the top of each inner shell 14.

The inner shells 14 are independently moveable and are slideable relative to the outer shell 12 through the access openings 18. The inner shells 14L, 14R are slideable between the closed position of FIG. 1 and the fully open position of FIG. 2, to provide access to the smoking articles. The inner shells 14 are slideable in a direction perpendicular to the direction of removal, i.e. the inn shells 14 are slideable laterally, whilst the direction of removal is upwards.

The front and rear major lateral walls 20, 21 of the outer shell 12 each have two recesses R. In the depicted embodiment, one recess R is provided along each vertical edge of each major lateral wall 20, 21; i.e. the recesses are adjacent to, and on either side of, the access openings 18.

The recesses R assist gripping of the inner shells 14 when the package 10 is in the closed position of FIG. 1.

The recesses R are elongate and extend most of the length along the vertical edges of the major lateral walls 20, 21.

Figure 7C:
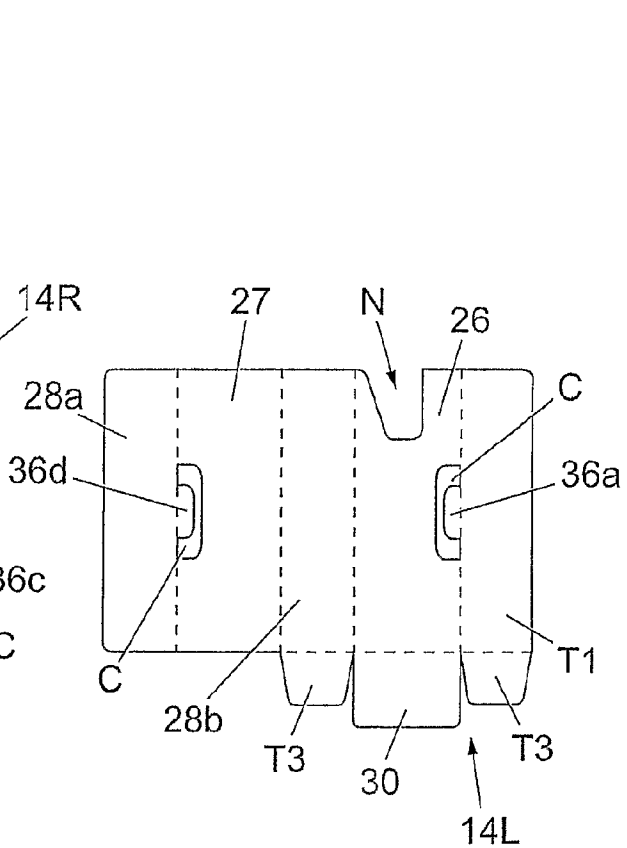
FIGS. 7A, 7B and 7C show an assembly of blanks corresponding to the first embodiment of FIGS. 1 to 6
Figure 7B:
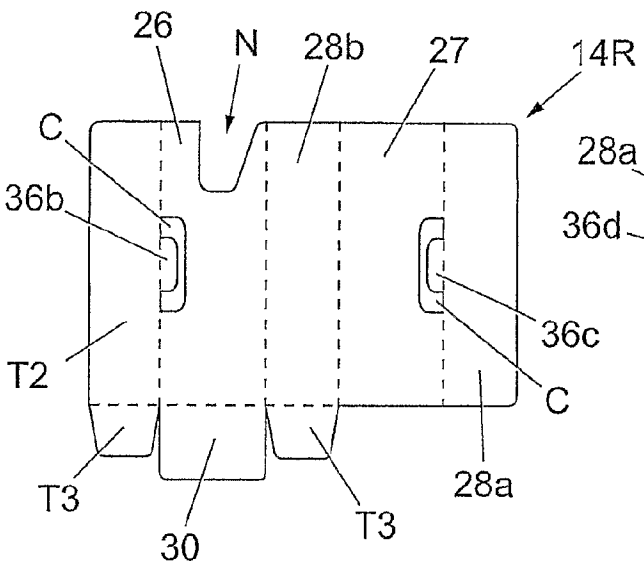
Figure 7A:
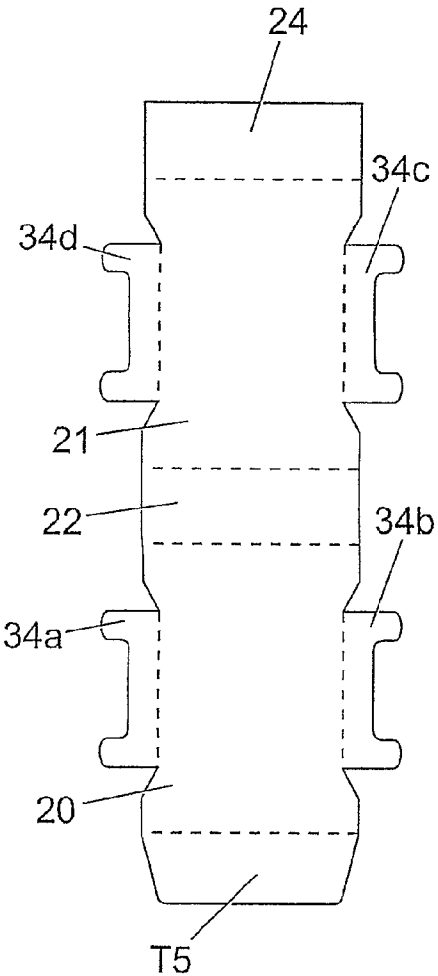
Figure 7D:
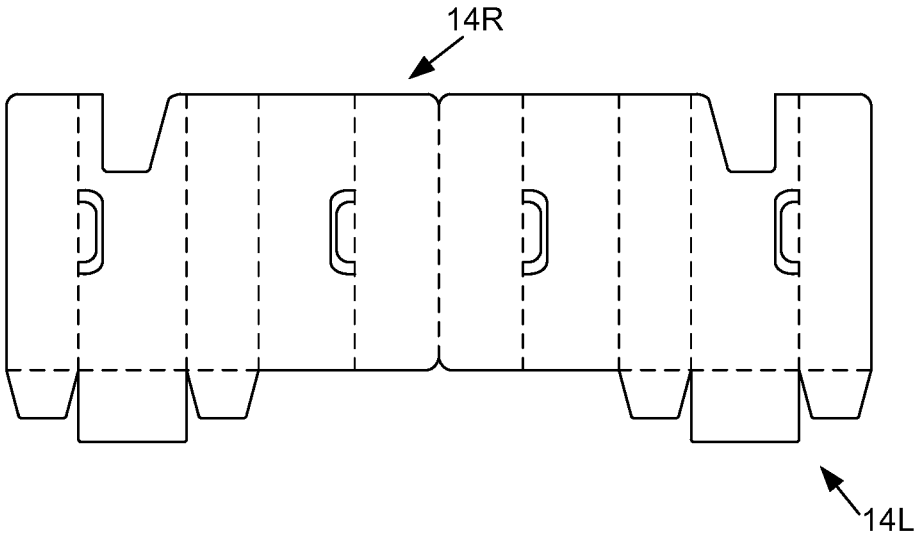
FIG. 7D shows an inner compartment blank comprising two inner shells.

FIGS. 7A, 7B and 7C show a blank assembly that is used to form the embodiment of the package depicted in FIGS. 1 to 6.

For simplicity, the panels in the blank assembly have been designated with the same reference numbers as the walls that they respectively form in the assembled pack. Thus, the "walls" in the FIGS. 1 to 6, are denoted as "panels" in FIG. 7, e.g. the front major lateral wall 20 of FIGS. 1 to 6 corresponds to the front major lateral panel 20 of FIG. 7A. Also, the "inner shell 14" in FIGS. 1 to 6, is denoted the "inner shell blank 14" in FIG. 7, and likewise "outer shell/panel 12".

In addition to the walls/panels already described with reference to FIGS. 1 to 6, each inner shell blank 14L, 14R has a respective flap T1, T2 located laterally adjacent to the front major lateral panel 26. The flaps T are of approximately the same width and length as the minor lateral panels 28*a*, 28*b* in this embodiment, alternative embodiments being possible with flaps of differing widths and/or lengths. The minor lateral panel 28*b* and flaps T1 and T2 each have a tab T3, formed as an extension and depending from their lower edges. The front major lateral panels 26 each have a bottom end panel 30 depending from a lower edge thereof. The edges from which tabs T3 and bottom end walls 30 depend are formed of a fold line in the blank.

The outer shell blank 12 also has a flap T5 depending from front major lateral panel 20 and joined thereto along a fold line. The flap T5 has similar dimensions to the bottom end panel 24.

The panels of the outer shell and inner shell blanks are defined by crease/fold lines (shown by dashed lines in FIG. 7), which make the blanks easier to fold in a pre-determined manner. Optionally, in embodiments where the blanks are intended to be formed into a package with at least one non-square edge, the single crease lines of FIG. 7 could be replaced by a plurality of crease lines, located adjacent to each other and close together, thus facilitating the formation of a rounded-edge. Alternative edge shapes are envisaged and will be within the understanding of the skilled artisan.

A respective locking means is provided for each inner shell 14, for limiting the movement of the inner shell 14 relative to the outer shell 12, thereby defining a fully open position (shown in FIGS. 2, 4, 5 and 6), beyond which further movement of the inner shell 14 is restricted or prevented. In the depicted embodiment, each locking means comprises two pairs of co-operating tongues. It will be well understood that alternative embodiments of the present invention may provide a locking means comprising one pair of co-operating tongues for each inner shell 14.

One pair of co-operating tongues 34*a*, 36*b* will now be described in detail.

A first tongue 34*a* is provided on the outer shell 12, as a left lateral extension of, and depending along a fold line from, the front major lateral wall 20, connected thereto at the recess R. The first tongue 34*a* is folded inside the outer shell 12 that it is not visible from the outside of the package 10.

A second, co-operating tongue 36*a* is provided on the left inner shell 14L. The second tongue 36*a* comprises part of the front major lateral wall 26 of the left inner shell 14L. Specifically, the second tongue 36 is defined by a c-shaped cut-out C in the front major lateral wall 26; the cut-out C encircling the second tongue 36*a*. The ends of the c-shape are located along the edge that connects the front major lateral wall 26 with the flap T1. Hence, the second tongue 36*a* is provided in the front major lateral wall 26 adjacent to the "trailing end" of the left inner shell 14L, the trailing end being defined with respect to the direction of opening of the package 10.

The tongues 34*a*, 36*b* interlock when the inner shell 14L is in the fully open position of FIG. 2, with the second tongue 36*a* being held by the folded first tongue 34*a* that lies within the outer shell 12.

A second pair of co-operating tongues 34*b*, 36*b* is provided in a similar manner. The first tongue 34*b* is provided as a right lateral extension of the front major lateral wall 20 of the outer shell 12. The first tongue 34*b* engages another second tongue 36*b*, which comprises part of the front major lateral wall 26 of the right inner shell 14R. The tongues 34*b* and 36*b* are mirror images of the tongues 34*a* and 36*b*, and connect in the same way. Whilst this may be preferred from a manufacturing perspective, it is within the scope of the invention to have first co-operating tongues which are of a different configuration than second co-operating tongues.

Further pairs of co-operating tongues 34*c*, 36*c* and 34*d*, 36*d* are provided in the same way on the rear side of the package 10; as these are the same, the description will not be repeated here. Depending on the packaging materials and design determinations, a skilled worker may choose to modify this embodiment by providing one or no pairs of co-operating tongues on the rear of the package.

Hence, two pairs of co-operating tongues are provided for each inner shell 14 14R, each pair of co-operating tongues being provided on adjacent lateral surfaces of the outer and inner shells 12, 14L, 14R. Specifically, the tongue pairs 34*a*, 36*a* and 34*d*, 36*d* limit the movement of the left inner shell 14L, and the tongue pairs 34*b*, 36*b* and 34*c*, 36*c* limit the movement of the right inner shell 14R.

The front major lateral wall 26 of each inner shell 14 has a cut-out portion N in an upper edge thereof, to facilitate removal of the smoking articles from the inner shell 14.

Figure 4:
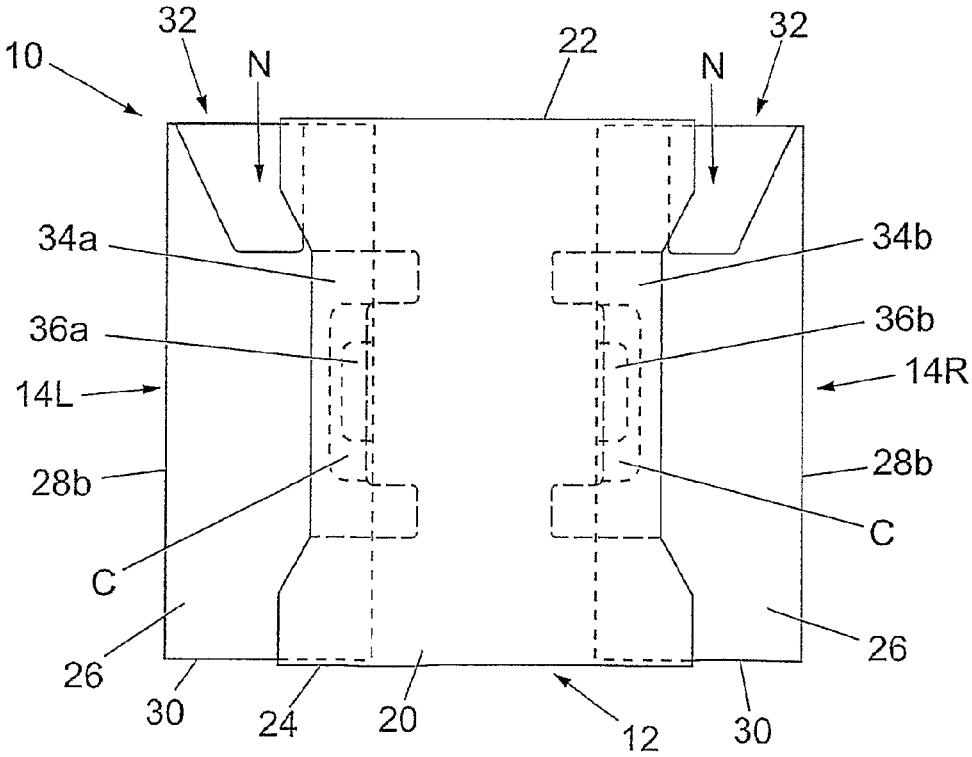
FIG. 4 shows a front view of the package of FIG. 2.
Figure 5:
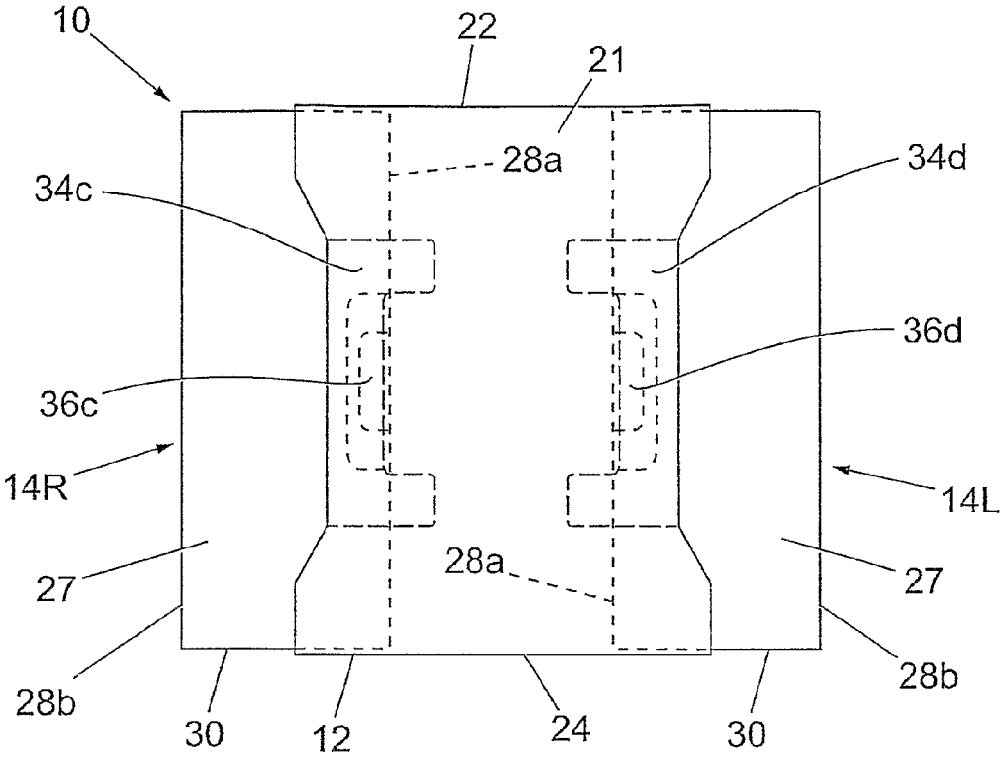
FIG. 5 shows a rear view of the package of FIG. 2.

As best shown in FIGS. 2 and 4, the cut-out portion N is effectively a recess in the upper edge of the front major lateral wall 26. In this embodiment, the cut-out portion N has one vertical edge, a horizontal lower edge, and an inclined edge; however, the cut-out portion N could take any convenient shape that allows finger access to the smoking articles (e.g. cigarettes) for easy removal.

Figures 8A, 8B, 8C:
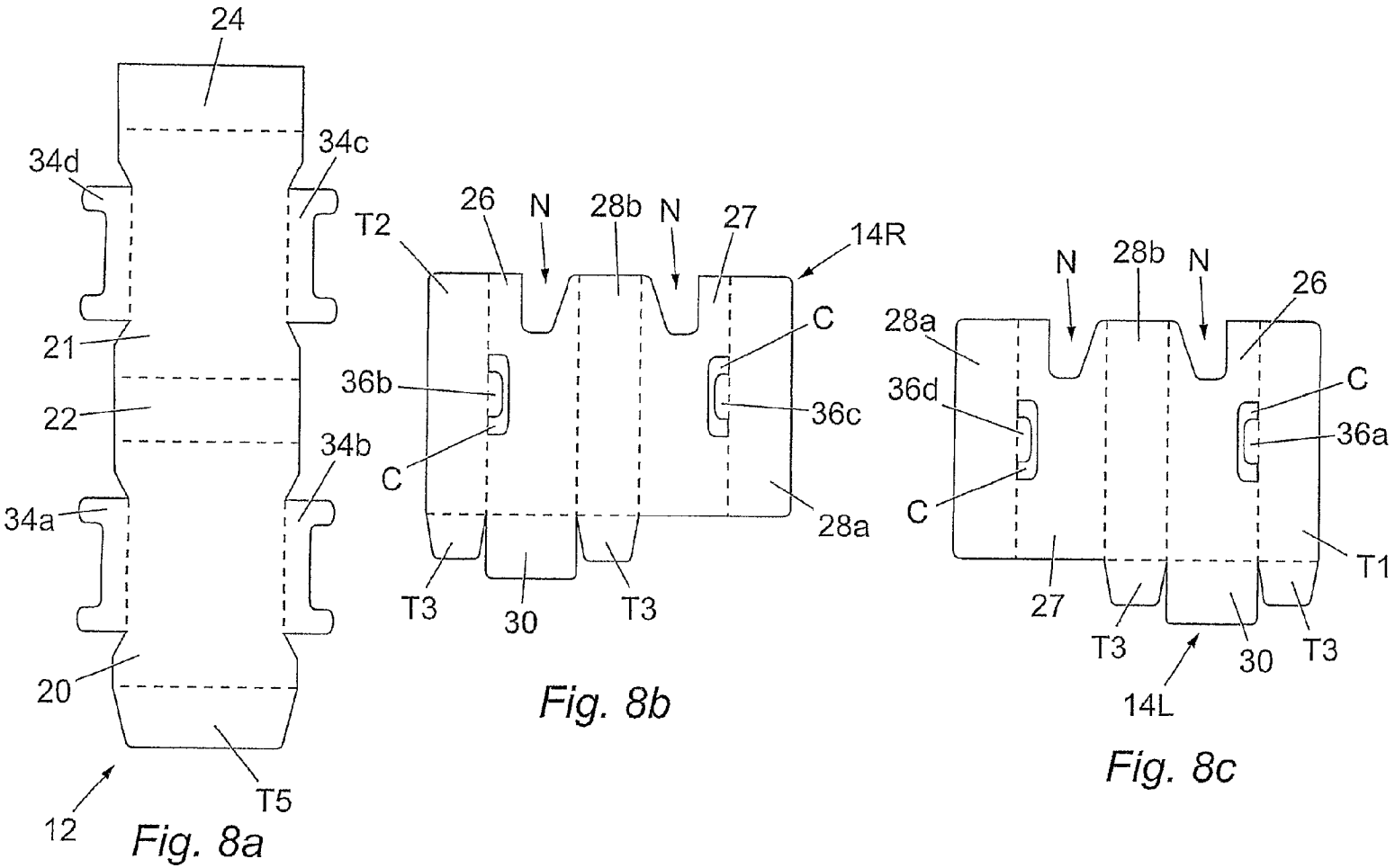
FIGS. 8A, 8B and 8C show an assembly of blanks corresponding to a second embodiment.

In an alternative embodiment, a cut-out portion N could be provided in the rear major lateral wall 27 of each inner shell 14, as well as the front major lateral wall 26. FIGS. 8A, 8B and 8C show a blank assembly corresponding to this modified embodiment. This blank assembly is the same as that of FIGS. 7A, 7B and 7C, with the exception of the additional cut-out portions N in the rear major lateral walls 27. Such embodiments allow easy access to the smoking articles in both inner shells 14 to both right-handed and left-handed consumers.

Figure 8E:
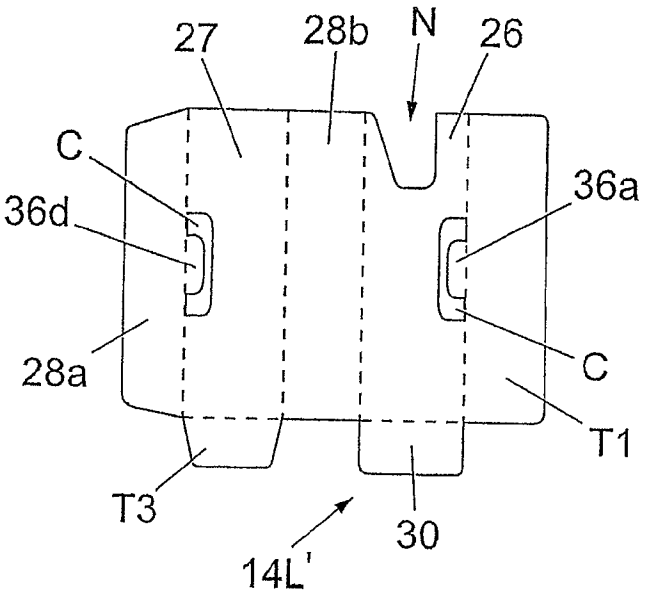
FIGS. 8D and 8E show an assembly of inner shell blanks corresponding to a third embodiment.
Figure 8D:
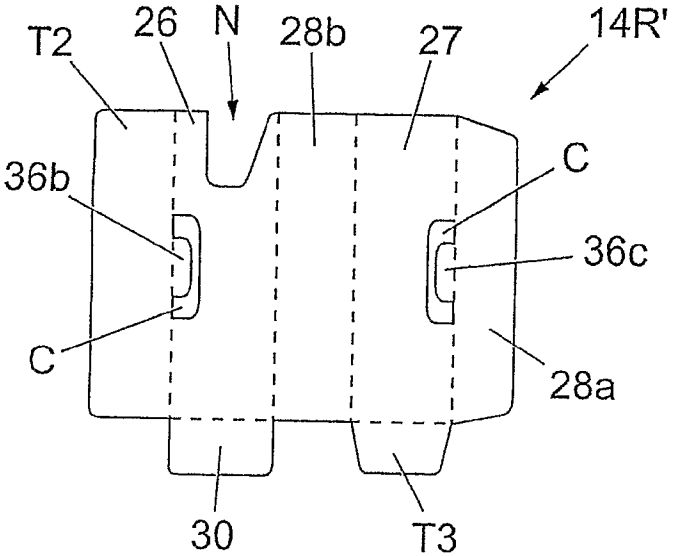

FIGS. 8*d* and 8*e* show a further alternative embodiment of the inner shells 14R' and 14L' for use with the outer shell 12 of FIG. 8*a*. The inner shell 14R' of FIG. 8*d* is the same as the inner shell 14R of FIG. 8*b*, except for the following features. The two tabs T3 of FIG. 8*b* are replaced by a single tab T3 that forms a lower extension of the rear major lateral panel 27. The sides of the tab T3 converge towards each other (are inwardly tapered) in the direction away from the rear major lateral panel 27.

The minor lateral panel 28*a* also has inwardly tapering side walls in the direction away from the rear major lateral panel 27. The notch N in the rear major lateral panel 27 is omitted. The inner shell 14L' of FIG. 8*e* corresponds to the inner shell 14L of FIG. 8*c*, with the same changes made as described for the right shell 14R'. When the inner shell blanks 14R', 14L' of FIGS. 8*d* and 8*e* are assembled, the tabs T3 are folded so as to lie against the inner surface of the bottom end walls 30, and are glued to the bottom end walls 30 to form the bases of the inner shells. The tapered minor lateral panels 28*a* are placed inwardly of the tabs T1, T2, and are glued thereto, so that the tabs T1, T2 form the outer walls.

It is not essential that the locking means be provided on adjacent lateral surfaces of the outer and inner shells 12, 14, as shown in FIGS. 1 to 8. Alternative embodiments can have a locking means that is provided on adjacent top and bottom end surfaces of the outer and inner shells 12, 14.

Figure 9:
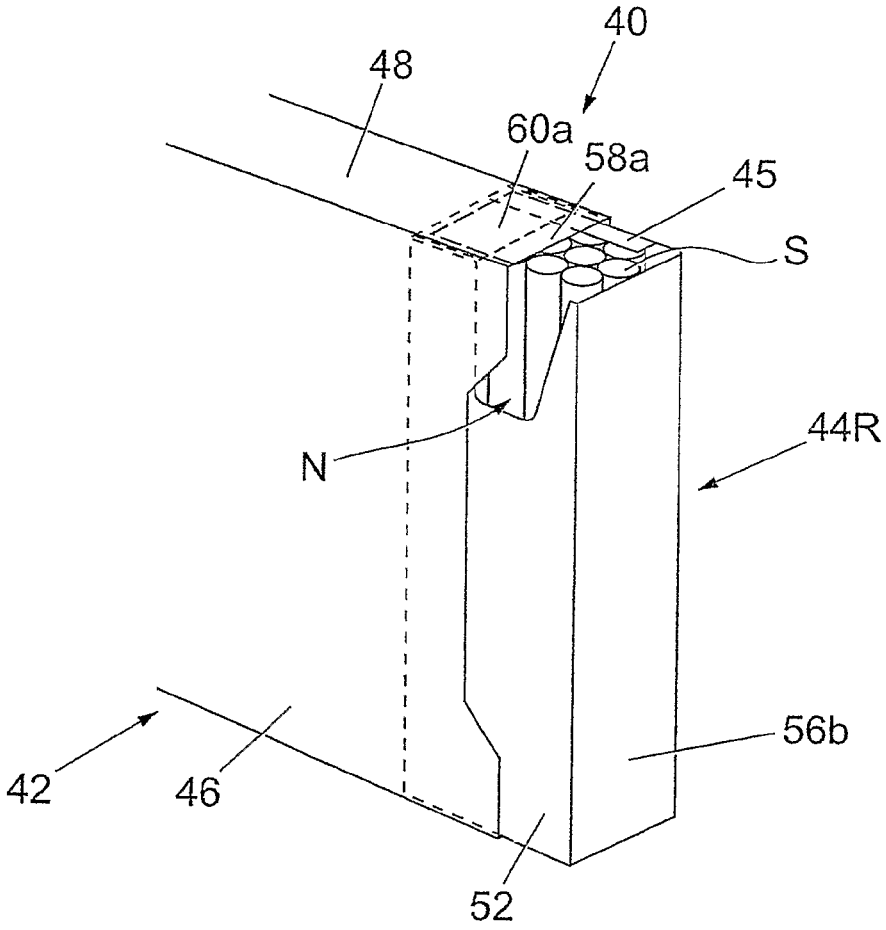
FIG. 9 shows a perspective view of part of a fourth embodiment of the invention.

FIGS. 9 and 10 show one such embodiment. A package 40 comprises an outer shell 42 and left and right inner shells 44L, 44R. The outer shell 42 and the inner shells 44 are the same as the outer shell 12 and inner shells 14, except that they do not have the lateral tongue pairs 34*a*, 36*a*; 34*b*, 36*b*; 34*c*, 36*c*; 34*d*, 36*d*.

In particular, the outer shell 42 has a front major lateral wall 46, a rear major lateral wall 47, a top end wall 48 and a bottom end wall 50. The outer shell 42 also includes a flap T5 formed as a lower extension of the front major lateral wall/panel 46, and depending therefrom along a fold line in the blank as depicted in FIG. 10*a*.

Each inner shell 44 has a front major lateral wall 52, a rear major lateral wall 54, and two minor lateral walls 56*a*, 56*b*. Each inner shell 44 also has tabs T3 formed as lower extensions depending along respective fold lines from the minor lateral wall 56*b* and flaps T1 and T2, and a bottom panel 30 formed as a lower extension depending along a fold line from the front major lateral wall/panel 52. Flaps T1, T2 are formed by lateral extensions of the front major lateral walls 52.

The package 40 has a locking means comprising four pairs of interlocking tongues. A pair of tongues 58*a*, 60*a* will be described first.

A first tongue 58*a* is provided on the outer shell 42, as a right lateral extension of the top end wall/panel 48. The first tongue 58*a* is folded inside the outer shell 42, so that it is not visible from the outside of the package 10.

A second, co-operating tongue 60*a* is provided on the tight inner shell 44R, as an upper extension of the minor lateral panel 56*a*. The second tongue 60*a* is folded so that it is perpendicular to the minor lateral panel 56*a*.

When the inner shell 44R is pulled out of the outer shell 42 to the fully open position shown in FIG. 9, the tongues 58*a*, 60*a* interlock to prevent further movement of the inner shell 44R and dislocation of the inner shell 44R from the outer shell 42.

A further pair of co-operating tongues 58*b*, 60*b* is provided at the bottom end wall 50, these tongues being a mirror image of the tongues 58*a*, 60*a*. Two further pairs of co-operating tongues 58*c*, 60*c*; 58*d*, 60*d* are provided, to lock the left inner shell 44L. All pairs of tongues 58, 60 are similar and work in the same way.

A further difference from the embodiment of FIGS. 1 to 7 is that the rear major lateral panels 54 of the inner shells 44L, 44R have upper extension flaps 45. Each flap 45 is folded perpendicular to the rear major lateral wall 54. As best shown in FIG. 9, the flap 45 is folded so that it lies beneath the co-operating tongues 58*a*, 60*a*, and serves to separate the tongues from the smoking articles (cigarettes) S. This helps to prevent the smoking articles S from disrupting the functioning of the locking means.

FIG. 10*d* shows alternative forms of the recess R. As shown, the recess R could comprise one or more discrete cut-outs, for example, part-circular, square shaped, or a tapered square shape, of approximately finger width. As will be understood, many alternative shapes of cut-outs other than those listed herein can be envisaged, thus the depicted alternatives merely provide illustrative embodiments of the configuration of recess R. The shape of the recess R is inessential to the invention.

A potential drawback with this embodiment is that the tabs 58*a*-58*d* can be pushed outwardly of the package if the package is misused, for example, if the left inner shell 44L is pulled out and the right inner shell 44R is pushed into a hyper inwardly-extended position then returned to its usual position. This can force the tabs 58*a*, 58*b* outwardly of the package which is unsightly and defeats the locking function. One way to prevent this drawback is to provide tabs 58*a*-58*d* with extension portions parallel with the long edges of the top and bottom end walls 48, 50. The extension portions are typically only half of the width of the tabs 58*a*-58*d*. Corresponding with this modification would be a reduction in size of the tabs 60*a*-60*d* of the inner shells 44R, 44L. Specifically, the parts of the tabs 60*a*-60*d* that correspond in location to the extension portions of the tabs 58*a*-58*d* should be removed.

When the package is assembled, the extension portions prevent the minor lateral walls 56*b* from being able to push the tabs 58*a*-58*d* out of the package, even if the inner shells are pushed from a hyper inwardly-extended position. It will be readily understood that the potential drawback would also occur if the right inner shell 44R is pulled out and the left inner shell 44L is pushed into a hyper inwardly-extended position. On this occasion, tabs 58*c* and 58*d* are forced outwardly of the package. Other ways of preventing inferior pack performance due to misuse could be incorporated in addition to or instead of reconfigured tabs.

According to the invention, each of the two inner shells provides a discrete space for smoking articles. These articles can be wrapped (e.g. with metallised paper wrappers). Thus, whilst the smoking articles in one of the inner shells are being consumed, the smoking articles in the other are protected from environmental factors. Different types of products could be provided in each inner shell, these different products being easily selectable by the consumer. Optionally, differently shaped recesses can be provided to each side of the outer shell, and the recess shape could be associated with the articles provided in the inner shell immediately adjacent. Alternatively, different recess shapes could be provided on the front and rear major lateral walls of the outer shell, possibly as an indication of which side of the outer shell corresponds with a cut out opening in the inner shell housed therein.

Figure 11:
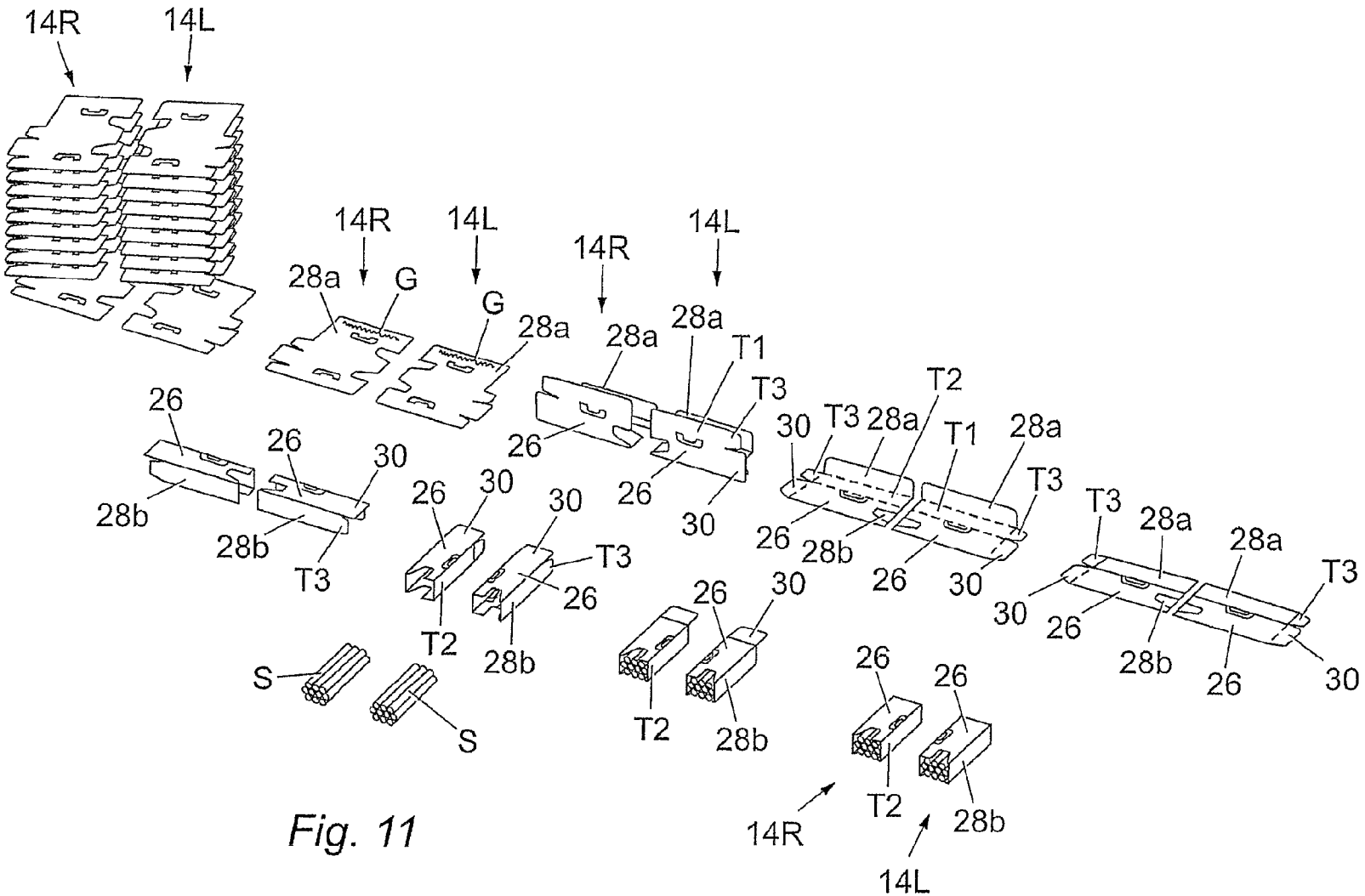
FIG. 11 shows a method of making two inner shells from the blank assembly of FIGS. 8A-C.
Figure 12:
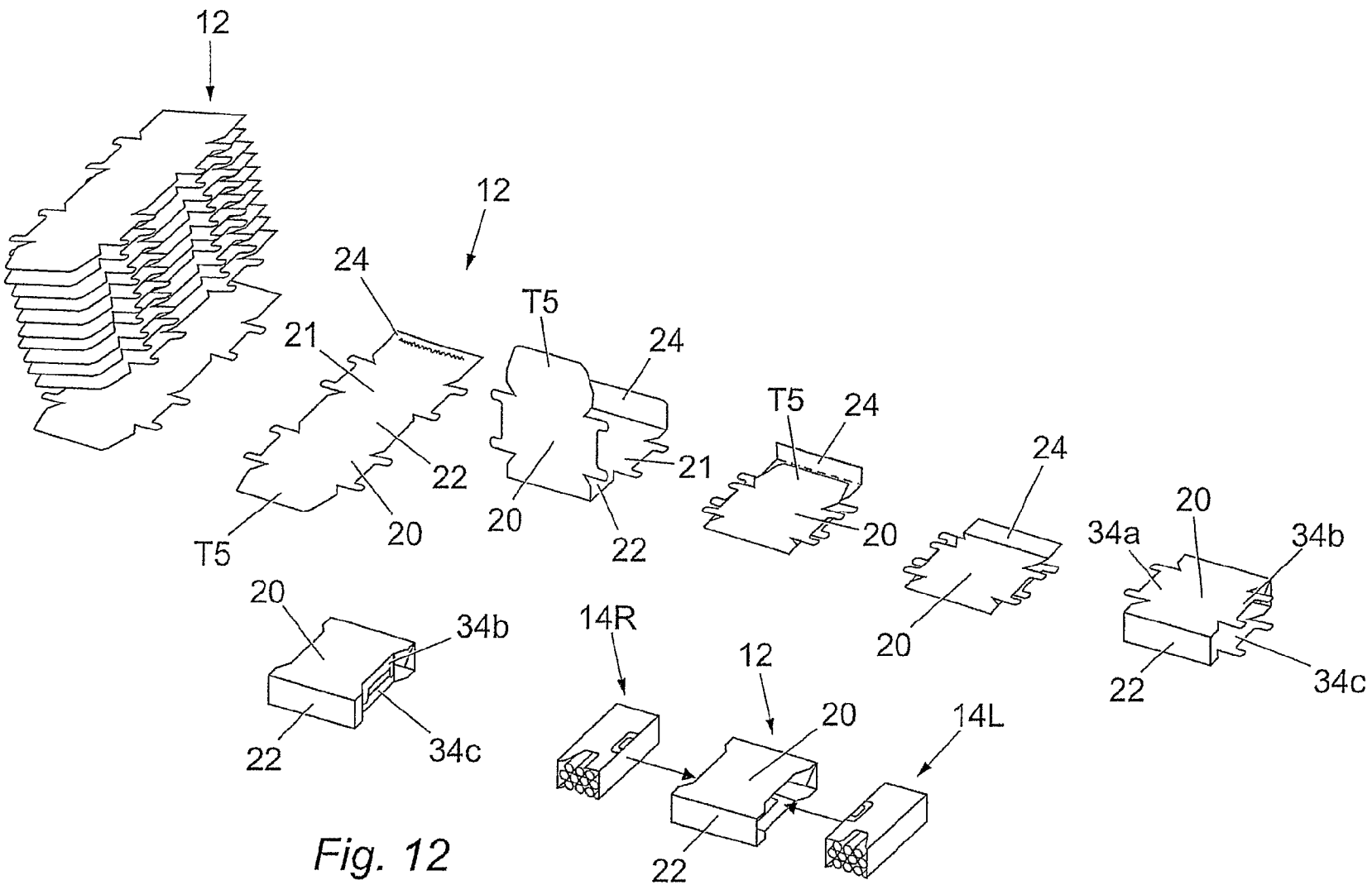
FIG. 12 shows a method of making an outer shell from the blank assembly of FIGS. 5A-C, and the insertion of two inner shells in the outer shell.

Referring now to FIGS. 8, 11 and 12, a method of forming a package from the blank assembly of FIG. 8 will now be described.

An apparatus for assembling the package from the blank assembly typically comprises at least two units, e.g. at least two machines. Although not specifically shown, their design and function can be implied from FIGS. 11 and 12.

FIG. 11 shows the formation of two inner shells 14L, 14R from the inner shell blanks. For simplicity, only the formation of the left inner shell 14L will be described, the right inner shell 14R being formed with the same steps. It should be noted that the inner shell blank stacks 14L, 14R in FIG. 15 are shown reverse side up, with respect to the FIG. 8 view.

In a first step, a line of glue G is applied to minor lateral panel 28*a*. The inner shell blank 14L is then folded along the crease line between the minor lateral panel 28*a* and the rear major lateral wall 27, and along the crease line between the front major lateral wall 26 and the minor lateral wall 28*b*. The front major lateral wall 26 and the flap T1 are then pushed flat to lie directly on top of the rear major lateral wall 27 and the minor lateral wall 28*b*.

The minor lateral wall 28*a* is then pushed flat on top of the flap T1 (glue side down), so that the flap T1 adheres to the minor lateral wall 28*a*. The inner shell 14L is then expanded from its flattened form into a box shape. The tabs T3 are folded inwardly at 90 degrees. The shell 14L is charged with a bundle of smoking articles S such that the bundle, which may be wrapped in an inner foil, rests on flaps T3. Glue is then applied to the (in the drawings) underside of the bottom panel 30. The bottom panel 30 is then folded inwardly, so as to adhere to the folded flaps T3. The inner shell 14L is now fully assembled. Alternatively, the inner shell 14L may be charged with a bundle of smoking articles S once bottom panel 30 has been folded so as to adhere to flaps T3.

Referring now to FIG. 12, to form the outer shell 12, a line of glue is applied to the bottom end wall 24. Bottom end wall 24 is then folded through 90 degrees along a fold line between end wall 24 and rear major panel 21. A further fold is then made along the fold line between the front major panel 20 and the top end wall 22. The front major panel 20 and flap T5 are folded through 180 degrees so as to lie flat directly on top of the top end wall 22 and the rear major panel 21. The bottom end wall 24 is then folded through a further 90 degrees, glue-side down, onto the flap T5, which adheres thereto. The outer shell 12 is then expanded from its flattened form into a box shape. The first tongues 34*a*, 34*b*, 34*c*, 34*d* are folded inwards through almost 180 degrees.

As a final step, the inner shells 14L, 14R are pushed into the open ends 18 of the outer shell, such that the second tongues 36*a*, 36*b*, 36*c*, 36*d* are pushed passed the first tongues 34*a*, 34*b*, 34*c*, 34*d*, and such that the inner shells 14L, 14R are fully inside the outer shell 12.

Any suitable apparatus can be used to assemble the package 10 in the steps set out above. The inner shells could be formed by a first machine, the outer shells by a second machine and the assembly performed by a third machine. Alternatively, the second machine could also perform the assembly step. Further alternatively, all assembly steps could be taken by a single machine. Alternatively, some or all assembly steps could be done by hand. Alternatively, a different folding method may be employed. For example, all of the folds could be made in a first step, followed by a gluing and assembly second step. Folding of the blanks is preferably undertaken at folding stations by plunge folding means. Alternatively, the inner and outer shells may be formed about an arbour as will be known in the art.

The blank assembly of FIG. 7 can be assembled into the embodiment of FIGS. 1 to 6 in the same way.

The blank assembly of FIG. 10 can be assembled into the embodiment of FIG. 9, largely in the same way, with the tongues 58*a-d* being folded inwards, in place of the tongues 34*a-d*, and the tongues 60*a-d* and the flap 45, in place of the tongues 36*a-d*. The flap 45 is folded before the tongues 60*a*, 60*c*, such that these tongues sit on top of the flap 45.

The terms front wall, top wall, rear wall and bottom wall do not imply any particular orientation of the pack and can equally well be replaced by the terms first wall, second wall, third wall and fourth wall respectively, where each occurs.

Modifications and improvements may be incorporated without departing from the scope of the invention. For example, graphics and/or indicia may be provided on none, some, or all of the surfaces of the package. In particular, such graphics and/or indicia could be provided on front, rear, bottom end walls and/or top end walls of the inner shells.

Embodiments of the invention could have a locking means provided at any suitable location. Some embodiments need not have any locking means.

In an alternative method and apparatus of assembly, the inner shell blank could be formed into the inner shell, and the outer shell blank could be formed around the inner shell, after the inner shell has been formed. Hence, it is not essential that the inner shell(s) and the outer shell are formed first, before the package is assembled.

Each of the plurality of compartments could optionally house a different type of smoking article, for example a different flavour of cigarettes. Alternatively, each compartment could house a different product altogether, e.g. cigarettes in one compartment and snuff in the other.

In some embodiments, more than two compartments could be provided. e.g. in the FIG. 2 embodiment, each inner shell 14R, 14L could be sub-divided by internal walls into a plurality of compartments.

The gripping recess is not an essential element of the invention. For example, at least one, or all access openings of the outer shell may be non-recessed. Optionally, in such embodiments, the inner shells may comprise a gripping tab for facilitating gripping and sliding the inner shell relative to the outer shell. Alternatively, the edges of the inner shell, i.e., the interfaces between the major and minor lateral walls, could form something other than a 90 degree intersection such as a curved or bevelled edge, so that a user could grasp and draw out the inner shells. In fact, any of the embodiments could have any number of non-square edges such as those shown in WO 2004/024595.

The present invention is not limited to single bundles of cigarettes. For example, multiple bundles, each within an inner compartment, may be overwrapped together in a single pack-forming sheet, to form a semi-rigid pack containing multiple bundles.

As is conventional, the smoking articles S are typically wrapped in an inner foil or a barrier layer within their respective compartments. The preferred material of the barrier layer will either be a plastics/metal foil laminate or a metallised plastics material since either of these offer outstandingly good barrier properties. The barrier layer may be continuous over one minor end of the pack or charge, and have side seams along both minor sides of the pack and an envelope or similar fold over the opposite end. The barrier layer need not be applied in that manner—it can equally well be applied so as to be continuous over one minor side and sealed over both minor ends and one minor side.

The seams of the barrier layer may be formed using glue or heat-sealable strips which are added to the barrier layer for example, by being printed on. This finds particular applicability when the barrier layer is a metal/paper laminate or metallised paper. However, one or more external faces of a plastics laminate or foil may be of heat-sealable material.

It is preferable if the blank assemblies are designed such that the inner shell blank(s) and outer shell blank placed end-to-end tessellate, (i.e. can lie next to each other without overlap or gaps) thus minimising the amount of material needed.

The invention claimed is:

1. A package for smoking articles comprising:

an outer shell having two major lateral walls and two minor lateral walls; and a plurality of inner shells, each adapted to receive smoking articles, the inner shells being slideable relative to the outer shell along a common straight line to provide access to the smoking articles, each inner shell being independently slideable in the outer shell; the outer shell comprising:

a first open end providing a first access opening at one end of an inner shell, that is bounded by said two major and said two minor lateral walls, through which a first of the inner shells is slideable in engagement with said two major lateral walls and two minor lateral walls; and a second open end providing a second access opening that is bounded by said two major and said two minor lateral walls and disposed at the opposite end of the inner shell to said one end, through which a second of the inner shells is slideable in engagement with said two major lateral walls and two minor lateral walls, the inner shells being independently slideable along the common straight line in opposite directions from a closed configuration, in which both of the inner shells are within the outer shell, to a fully open position; and wherein a respective locking means is provided for each inner shell, each locking means being adapted to limit the movement of the inner shell relative to the outer shell, thereby defining the fully open position, beyond which further movement of the inner shell is one of restricted and prevented.

2. The package according to claim 1, wherein at least one of the lateral walls has at least one recess adjacent to at least one of the first and second access openings, to assist gripping of an inner shell.

3. The package according to claim 2, wherein the at least one recess is provided in a major lateral wall.

4. The package according to claim 3, wherein both of the major lateral walls have a respective recess adjacent to each access opening.

5. The package according to claim 2, wherein the recess is elongate and extends along a substantial length of the lateral surface adjacent to the at least one of the first and second access openings.

6. The package according to claim 2, wherein the recess comprises one or more discrete cutouts.

7. The package according to claim 1,
wherein each inner shell comprises:
a lateral surface comprising two major lateral walls and two minor lateral walls;
a bottom wall; and
a top comprising an access opening.

8. The package according to claim 7,
wherein a removable or resealable cover is provided on the access opening.

9. The package according to claim 7,
wherein the lateral surface of the inner shell has at least one cut-out portion in an edge thereof, to facilitate removal of the smoking articles from the access opening of the inner shell.

10. The package according to claim 9,
wherein each major lateral wall of the inner shell has a respective cut-out portion.

11. The package according to claim 7,
wherein the access opening defines a direction of removal of the smoking articles.

12. The package according to claim 11,
wherein the inner shells are slideable in a direction perpendicular to the direction of removal of the smoking articles.

13. The package according to claim 1,
wherein the locking means comprises at least one pair of co-operating tongues,
wherein a first tongue is provided on the outer shell and a second tongue is provided on the inner shell, the tongues being adapted to interlock when the inner shell is in the fully open position.

14. The package according to claim 1,
wherein the locking means is provided on adjacent lateral surfaces of the outer and inner shells.

15. The package according to claim 1,
wherein the locking means is provided on adjacent top and bottom end surfaces of the outer and inner shells.

16. The package according to claim 1,
wherein edges of the plurality of the inner shells are substantially square, non square, beveled, rounded, or a combination thereof.

17. The package according to claim 1,
wherein edges of the outer shell are substantially square, non square, beveled, rounded, or a combination thereof.

18. An assembly of blanks for a smoking article package comprising:
an outer shell blank having two major panels and two minor panels; and
at least one inner compartment blank comprising two major panels and two minor panels;
wherein a plurality of inner shells are formable from the at least one inner compartment blank and wherein an outer shell is formable from the outer shell blank, each inner shell when formed being independently slideable in the outer shell along a common straight line in opposite directions from a closed configuration in which both of the inner shells are within the outer shell to a fully open position, the outer shell comprising:
a lateral surface with two major lateral walls and two minor lateral walls;
a first open end providing a first access opening at one end of the inner shell, that is bounded by said major and minor lateral walls, through which a first of the inner shells is slideable in engagement with said two major lateral walls and two minor lateral walls; and
a second open end providing a second access opening that is bounded by said major and minor lateral walls and disposed at the opposite end of the inner shell to said one end, through which a second of the inner shells is slideable in engagement with said two major lateral walls and two minor lateral walls; and
the blanks defining a respective locking means for each inner shell, each locking means being adapted to limit the movement of the inner shell relative to the outer shell, thereby defining the fully open position, beyond which further movement of the inner shell is one of restricted and prevented.

19. The assembly of blanks according to claim 18,
wherein one inner compartment blank is adapted to form two inner shells.

20. The assembly of blanks according to claim 18,
wherein two inner compartment blanks are provided, each inner compartment blank being adapted to form a respective inner shell.

21. The assembly of blanks according to claim 18,
wherein a major panel of the at least one inner compartment blank has a cut-out portion in an edge thereof.

22. The assembly of blanks according to claim 21,
wherein both major panels of the at least one inner compartment blank have respective cut-out portions in an edge thereof.

23. The assembly of blanks according to claim 18,
wherein at least one of the major panels of the outer shell has a recess provided in a side thereof.

24. The assembly of blanks according to claim 23,
wherein both of the major panels of the outer shell have a respective recess provided in opposite sides thereof.

25. The assembly of blanks according to claim 18,
wherein a respective tongue is provided as an extension portion of at least one side of each major panel of the outer shell and co-operating tongues are comprised in at least one inner shell.

26. The assembly of blanks according to claim 18,
wherein, the locking means comprising a first tongue on the outer shell blank and a second tongue on the inner shell blank, the tongues being adapted to interlock when the inner shell is in the fully open position.

27. An apparatus for assembling a package, the apparatus being adapted to receive a stack of inner shell blanks and a stack of outer shell blanks and to assemble the package so as to provide at least one inner shell within an outer shell such that the assembled package provides a plurality of inner compartments within the outer shell, the plurality of inner compartments being slideable relative to the outer shell along a common straight line, the outer shell comprising:
a lateral surface comprising two major lateral walls and two minor lateral walls;
a first open end providing a first access opening at one end of the inner shell, that is bounded by said major and minor lateral walls, through which a first of the inner shells is slideable in engagement with said two major lateral walls and two minor lateral walls; and
a second open end providing a second access opening that is bounded by said major and minor lateral walls and disposed at the opposite end of the inner shell to said one end, through which a second of the inner shells is slideable in engagement with said two major lateral walls and two minor lateral walls; and
wherein at least one of the lateral walls includes at least one recess adjacent to at least one access opening, to assist gripping of an inner shell,
each inner shell being independently slideable along the common straight line in opposite directions from a closed configuration in which both of the inner shells are within the outer shell to a fully open position in the outer shell; and wherein a respective locking means is provided for each inner shell, each locking means being adapted to limit the movement of the inner shell relative to the outer shell, thereby defining the fully open position, beyond which further movement of the inner shell is one of restricted and prevented.

28. A method of making a package, comprising:

providing an outer shell blank and at least one inner shell blank; and assembling the package so as to provide at least one inner shell within an outer shell such that the assembled package provides a plurality of inner compartments within the outer shell, the plurality of inner compartments being slideable relative to the outer shell along a common straight line, the outer shell comprising:

a lateral surface comprising two major lateral walls and two minor lateral walls;

a first open end providing a first access opening at one end of the inner shell, that is bounded by said major and minor lateral walls, through which a first of the inner shells is slideable in engagement with said two major lateral walls and two minor lateral walls; and a second open end providing a second access opening that is bounded by said major and minor lateral walls and disposed at the opposite end of the inner shell to said one end, through which a second of the inner shell is slideable in engagement with said two major lateral walls and two minor lateral walls; and wherein at least one of the lateral walls includes at least one recess adjacent to at least one access opening, to assist gripping of an inner shell, each inner shell being independently slideable along the common straight line in opposite directions from a closed configuration in which both of the inner shells are within the outer shell to a fully open position in the outer shell, and a respective locking means is provided for at least one said inner shell; and wherein a respective locking means is provided for each inner shell, each locking means being adapted to limit the movement of the inner shell relative to the outer shell, thereby defining the fully open position, beyond which further movement of the inner shell is one of restricted and prevented.

29. The method according to claim 28, wherein, the locking means comprising a first tongue on the outer shell and a second tongue on the inner shell, the tongues being adapted to interlock when the inner shell is in the fully open position.

* * * * *

UNITED STATES PATENT AND TRADEMARK OFFICE

CERTIFICATE OF CORRECTION

PATENT NO. : 8,584,844 B2
APPLICATION NO. : 12/597879
DATED : November 19, 2013
INVENTOR(S) : Tearle It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 323 days.

Signed and Sealed this
Twenty-fourth Day of February, 2015

Michelle K. Lee

Michelle K. Lee
*Deputy Director of the United States Patent and Trademark Office*